US008574017B2

(12) United States Patent
Orner

(10) Patent No.: US 8,574,017 B2
(45) Date of Patent: Nov. 5, 2013

(54) ELECTRICAL CONTACT WITH ADJUSTABLE LENGTH

(75) Inventor: Jeffrey K. Orner, Boiling Springs, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 202 days.

(21) Appl. No.: 13/187,258

(22) Filed: Jul. 20, 2011

(65) Prior Publication Data

US 2013/0023157 A1 Jan. 24, 2013

(51) Int. Cl.
*H01R 9/24* (2006.01)

(52) U.S. Cl.
USPC ..... 439/884

(58) Field of Classification Search
USPC ..... 439/628, 884, 33, 32, 513, 515, 700
See application file for complete search history.

(56) References Cited

U.S. PATENT DOCUMENTS

| | | | | |
|---|---|---|---|---|
| 3,416,125 | A * | 12/1968 | Theve | 439/638 |
| 6,159,056 | A * | 12/2000 | Boyle | 439/700 |
| 7,476,132 | B2 * | 1/2009 | Xu | 439/700 |
| 7,682,206 | B2 * | 3/2010 | Kainz | 439/824 |
| 8,083,552 | B2 * | 12/2011 | Oishi | 439/700 |

* cited by examiner

*Primary Examiner* — Hae Moon Hyeon

(57) ABSTRACT

An electrical contact includes a primary segment having a primary outer end, and a secondary segment having a secondary outer end. An intermediate segment joins the primary and secondary segments together. The intermediate segment includes a primary segment connector engaged with the primary segment such that the intermediate segment is electrically and mechanically connected to the primary segment. The intermediate segment includes a secondary segment connector engaged with the secondary segment such that the intermediate segment is electrically and mechanically connected to the secondary segment. The electrical contact has a length defined from the primary outer end to the secondary outer end. At least one of the primary segment is selectively positionable relative to the primary segment connector of the intermediate segment or the secondary segment is selectively positionable relative to the secondary segment connector of the intermediate segment such that the length of the electrical contact is adjustable.

18 Claims, 6 Drawing Sheets

ELECTRICAL CONTACT WITH ADJUSTABLE LENGTH

BACKGROUND OF THE INVENTION

The subject matter herein relates generally to electrical contacts.

Electrical connector assemblies are widely used for electrically connecting various electrical components together. For example, electrical connector assemblies are often used to electrically connect two cables together, to electrically connect a cable to a circuit board, and to electrically connect two circuit boards together. Electrical connector assemblies typically include complementary electrical connectors that mate together. Each electrical connector includes a housing that holds electrical contacts that mate with the electrical contacts of the complementary electrical connector to establish an electrical path between the electrical components. The electrical contacts of an electrical connector extend along paths within the housing from a mounting side of the housing that mounts to, or terminates, the corresponding electrical component to a mating side along which the electrical connector mates with the complementary electrical connector. The paths of the electrical contacts may be approximately straight, for example for electrical connector assemblies that electrically connect electrical components that extend approximately parallel to each other. Alternatively, the paths of the electrical contacts may include bends or angles, for example for electrical connector assemblies that electrically connect electrical components that extend at an approximately right angle to each other.

Depending on the specific applications as well as other factors, the size of the housings of different electrical connectors may be different. More specifically, the distance between the mounting and mating sides as measured along the paths of the electrical contacts may be different. For example, different electrical connectors used to connect parallel electrical components may have housings that have different heights to accommodate a different spacing between the corresponding parallel components. Because of the differently sized housings, the electrical contacts within an electrical connector may have different lengths (defined along the paths) than the electrical contacts within a different electrical connector. The electrical contacts of different electrical connectors may have different lengths even when the different electrical connectors are similar (e.g., connectors that interconnect the same type of components), for example because even relatively small variations in the housing size of different connectors may require electrical contacts having different lengths to ensure adequate electrical connection to the complementary connector. An electrical contact designed for use within a specific electrical connector therefore may not be suitable for use within a different electrical connector having a differently sized housing. Accordingly, a manufacturer, supplier, and/or the like of different electrical connectors must fabricate and/or stock multiple different contact lengths, which may increase cost, complexity, and/or difficulty of manufacturing, supplying, and/or the like of different electrical connectors.

In view of the above, there is a need for an electrical contact that can be used with different electrical connectors having differently sized housings.

BRIEF DESCRIPTION OF THE INVENTION

In one embodiment, an electrical contact includes a primary segment having a primary outer end, and a secondary segment having a secondary outer end. An intermediate segment joins the primary and secondary segments together. The intermediate segment includes a primary segment connector engaged with the primary segment such that the intermediate segment is electrically and mechanically connected to the primary segment. The intermediate segment includes a secondary segment connector engaged with the secondary segment such that the intermediate segment is electrically and mechanically connected to the secondary segment. The electrical contact has a length defined from the primary outer end of the primary segment to the secondary outer end of the secondary segment. At least one of the primary segment is selectively positionable relative to the primary segment connector of the intermediate segment or the secondary segment is selectively positionable relative to the secondary segment connector of the intermediate segment such that the length of the electrical contact is adjustable.

In another embodiment, an electrical connector includes a housing having a contact opening, and an electrical contact held within the contact opening of the housing. The electrical contact includes a primary segment having a primary outer end, and a secondary segment having a secondary outer end. An intermediate segment joins the primary and secondary segments together. The intermediate segment includes a primary segment connector engaged with the primary segment such that the intermediate segment is electrically and mechanically connected to the primary segment. The intermediate segment includes a secondary segment connector engaged with the secondary segment such that the intermediate segment is electrically and mechanically connected to the secondary segment. The electrical contact has a length defined from the primary outer end of the primary segment to the secondary outer end of the secondary segment. At least one of the primary segment is selectively positionable relative to the primary segment connector of the intermediate segment or the secondary segment is selectively positionable relative to the secondary segment connector of the intermediate segment such that the length of the electrical contact is adjustable.

In another embodiment, an electrical contact includes a primary segment having a primary outer end, and a secondary segment having a secondary outer end. An intermediate segment joins the primary and secondary segments together. The intermediate segment includes a primary segment connector and a secondary segment connector. The primary and secondary segment connectors include springs that are biased to engage the primary and secondary segments, respectively, to electrically and mechanically connect the intermediate segment to the primary and secondary segments. The electrical contact has a length defined from the primary outer end of the primary segment to the secondary outer end of the secondary segment. At least one of the primary segment is slidable along the primary segment connector of the intermediate segment or the secondary segment is slidable along the secondary segment connector of the intermediate segment such that the length of the electrical contact is adjustable.

DETAILED DESCRIPTION OF THE INVENTION

Figure 1:
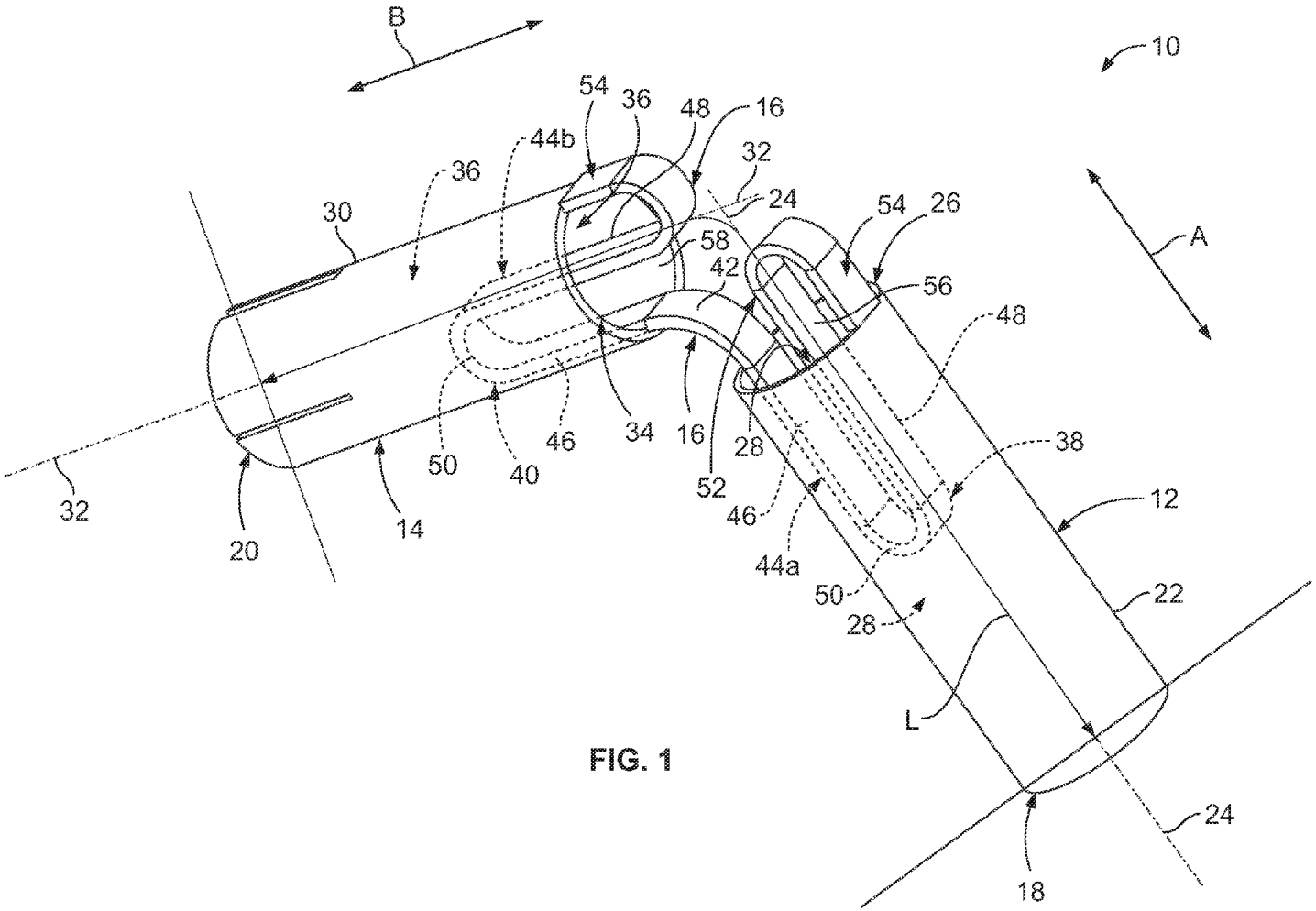
FIG. 1 is a perspective view of an exemplary embodiment of an electrical contact.
Figure 2:
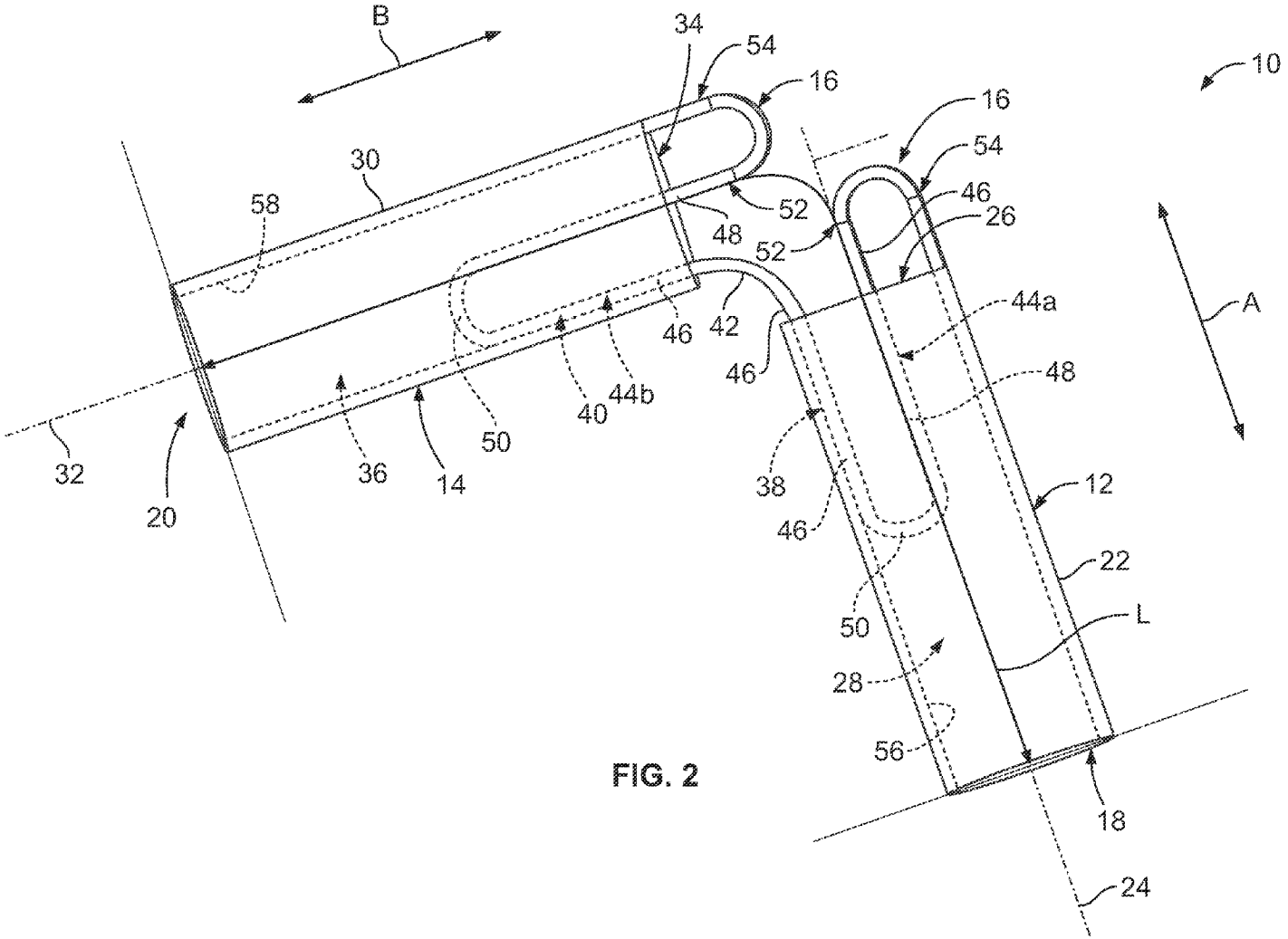
FIG. 2 is an elevational view of the electrical contact shown in FIG. 1.

FIG. 1 is a perspective view of an exemplary embodiment of an electrical contact 10. FIG. 2 is an elevational view of the electrical contact 10. Referring to FIGS. 1 and 2, the electrical contact 10 may be used with different types of electrical connector. For example, the electrical contact 10 may be used with an electrical connector that connects two circuit boards (not shown) together, an electrical connector that connects two cables (not shown) together, an electrical connector that connects a cable to a circuit board, an electrical connector that is an intermediary (connects) between two other electrical connectors, and/or the like.

The electrical contact 10 includes a segment 12, a segment 14, and an intermediate segment 16. The intermediate segment 16 joins the segments 12 and 14 together to establish an electrical and mechanical connection between the segments 12 and 14. The segments 12 and 14 include respective outer ends 18 and 20 that define outer ends of the electrical contact 10. The electrical contact 10 extends a length L defined along a contact centerline from the outer end 18 of the segment 12 to the outer end 20 of the segment 14. As will be described below in more detail, the segments 12 and 14 are each selectively positionable relative to the intermediate segment 16 such that the length L of the electrical contact 10 is adjustable.

Figure 6:
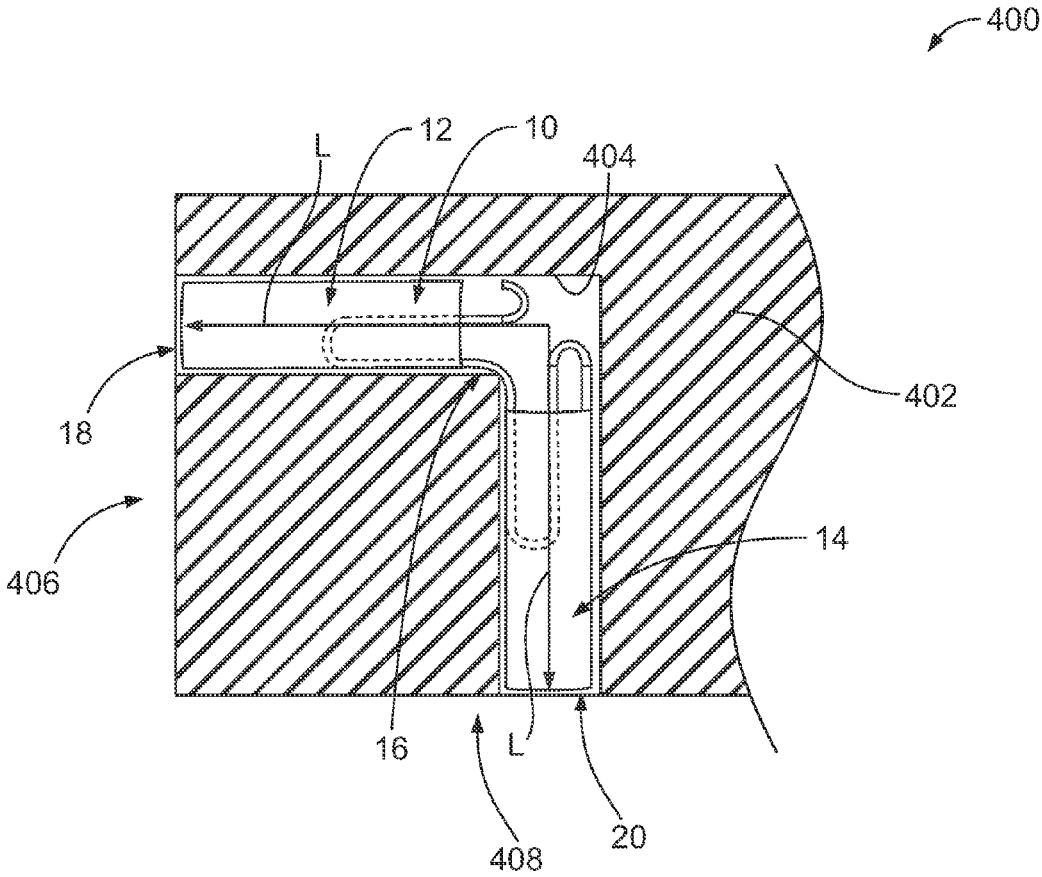
FIG. 6 is a cross-sectional view of a portion of an exemplary embodiment of an electrical connector.

The length L of the electrical contact 10 defines a path of the electrical contact 10 through the housing (e.g., the housing 402 shown in FIG. 6) of the electrical connector (e.g., the electrical connector 400 shown in FIG. 6). In the exemplary embodiment of FIGS. 1 and 2, the length L includes a bend of approximately 90°. In other embodiments, the length L of the electrical contact 10 is approximately straight or includes a bend of another angle besides 90°. The segment 12 may be referred to herein as a "primary" segment and/or a "secondary" segment. The segment 14 may be referred to herein as a "primary" segment and/or a "secondary" segment. The outer ends 18 and 20 may each be referred to herein as a "primary" outer end and/or a "secondary" outer end.

In the exemplary embodiment of FIGS. 1 and 2, the segment 12 includes a tube 22. The tube 22 extends a length along a central longitudinal axis 24 from an inner end 26 to the outer end 18. The tube 22 includes a passageway 28 that extends through the tube 22 along at least a portion of the length of the tube 22. The passageway 28 extends through the inner end 26. In the exemplary embodiment of FIGS. 1 and 2, the passageway 28 also extends through the outer end 18. Alternatively, the passageway 28 does not extend through the outer end 18. The segment 12 is not limited to the tube 22. Rather, the segment 12 may include other shapes in addition or alternative to the tube 22. Moreover, the tube 22 is not limited to having the circular cross-sectional shape shown herein. Rather, the tube 22 may include other shapes in addition or alternative to the circular cross-sectional shape, such as, but not limited to, a square cross-sectional shape, a rectangular cross-sectional shape, a triangular cross-sectional shape, and/or the like. The passageway 28 may include other shapes in addition or alternatively to the circular cross-section shape shown herein.

The outer end 18 of the segment 12 may be mounted to and/or terminate an electrical contact (not shown) or other type of electrical conductor (not shown) of an electrical component (not shown). The outer end 18 may have any configuration for mounting to and/or terminating any type of electrical contact or other type of electrical connector, such as, but not limited to, a surface mount configuration, a solder tail, a press-fit pin, a receptacle, a spring, and/or the like. In other embodiments, the outer end 18 of the segment 12 is configured to mate with a mating contact (not shown) of an electrical component, such as, but not limited to, another electrical connector (not shown) and/or the like. The outer end 18 of the segment 12 may have any configuration for mating with any type of mating contact, such as, but not limited to, a receptacle, a spring, a pin, and/or the like.

The exemplary embodiment of the segment 14 includes a tube 30 that extends a length along a central longitudinal axis 32. The length of the tube 30 is defined from an inner end 34 to the outer end 20. A passageway 36 extends through the tube 30 along at least a portion of the length of the tube 30. The passageway 36 extends through the inner end 34 and, in the exemplary embodiment of FIGS. 1 and 2, also through the outer end 20. Alternatively, the passageway 36 does not extend through the outer end 20 of the segment 14. In addition or alternative to the tube 30, the segment 14 may include other shapes. Moreover, the tube 30 may include other shapes in addition or alternative to the circular cross-sectional shape shown herein, such as, but not limited to, a square cross-sectional shape, a rectangular cross-sectional shape, a triangular cross-sectional shape, and/or the like. In addition or alternatively to the circular cross-section shape shown herein, the passageway 36 may include other shapes.

The outer end 20 of the segment 14 may be mounted to and/or terminate an electrical contact (not shown) or other type of electrical conductor (not shown) of an electrical component (not shown). The outer end 18 may have any configuration for mounting to and/or terminating any type of electrical contact or other type of electrical connector, such as, but not limited to, a surface mount configuration, a solder tail, a press-fit pin, a receptacle, a spring, and/or the like. In other embodiments, the outer end 20 of the segment 14 is configured to mate with a mating contact (not shown) of an electrical component (not shown), such as, but not limited to, another electrical connector (not shown) and/or the like. The outer end 20 of the segment 14 may have any configuration for mating with any type of mating contact, such as, but not limited to, a receptacle, a spring, a pin, and/or the like. In the exemplary embodiment, the outer end 18 of the segment 12 is configured to mount to and/or terminate an electrical component, while the outer end 20 of the segment 14 is configured to mate with a mating contact of an electrical connector.

Figure 3:
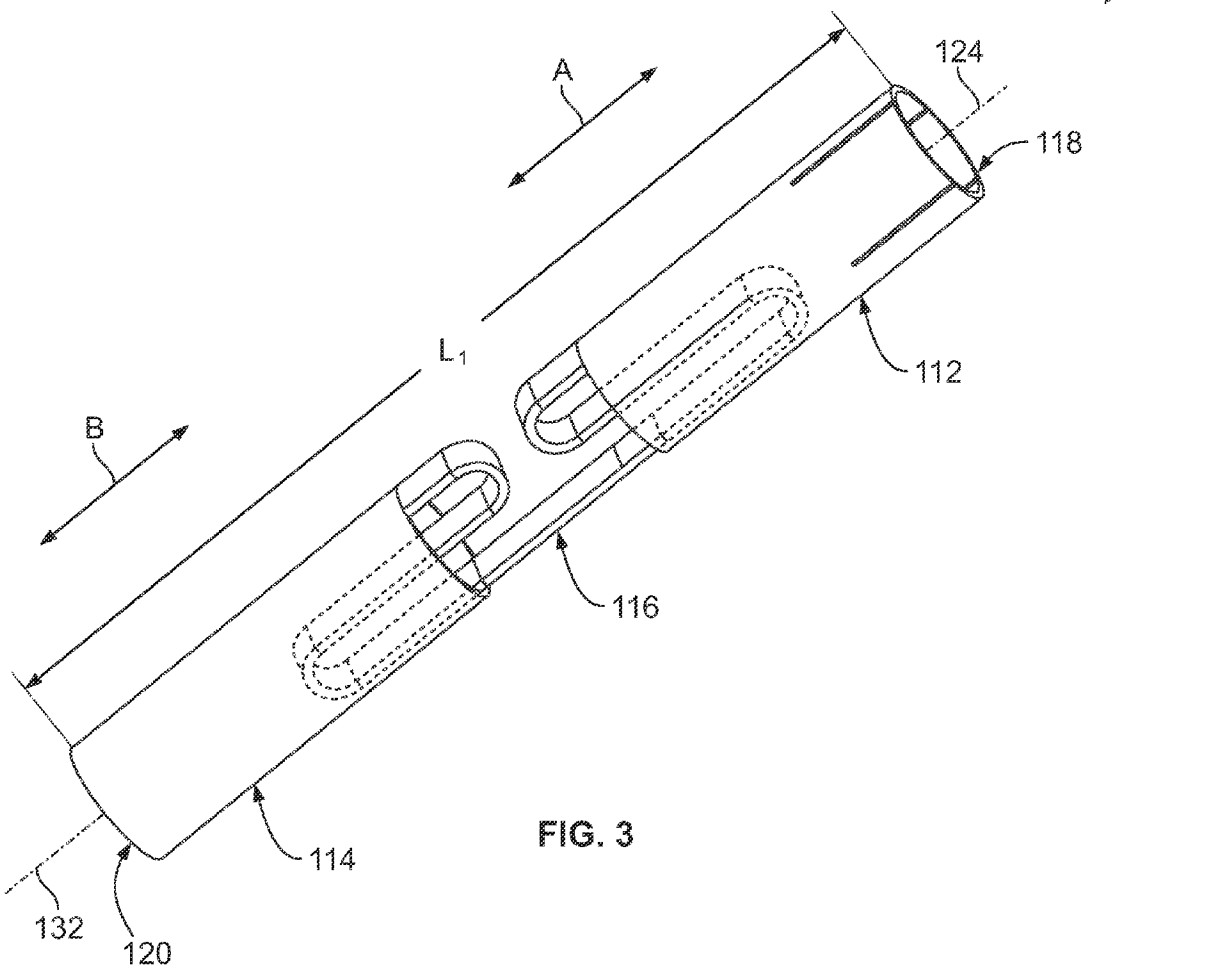
FIG. 3 is a perspective view of another exemplary embodiment of an electrical contact.

In the exemplary embodiment of FIGS. 1 and 2, the segment 12 extends at an approximate right angle (approximately 90°) to the segment 14. More specifically, the central longitudinal axis 24 of the segment 12 extends at an approximate right angle to the central longitudinal axis 32 of the segment 14. Accordingly, and as described above, the length L of the electrical contact 10 includes a bend of approximately 90°. Alternatively, the axes 24 and 32 are parallel, are angled relative to each other at another angle besides approximately 90°, are coincident with each other, or the like. For example, in some embodiments the axes 24 and 32 are coincident with each other such that the length L of the electrical contact 10 extends along an approximately straight path. FIG. 3, which will be described in more detail below, illustrates another embodiment of an electrical contact 110 wherein a length $L_1$ of the electrical contact 110 extends along an approximately straight path.

The intermediate segment 16 includes segment connectors 38 and 40. As will be described in more detail below, the segment connectors 38 and 40 engage the segments 12 and 14, respectively, such that the intermediate segment 16 is electrically and mechanically connected to the segments 12 and 14. The intermediate segment 16 includes a joinder sub-segment 42 and the segment connectors 38 and 40. The segment connectors 38 and 40 include respective spring members 44*a* and 44*b* that extend outwardly from opposite ends of the joinder sub-segment 42. In the exemplary embodiment of FIGS. 1 and 2, the joinder sub-segment 42 includes bend of approximately 90°. Each spring member 44*a* and 44*b* includes a pair of spring arms 46 and 48 that are connected together at a loop 50. As can be seen in FIGS. 1 and 2, the spring arm 46 extends outwardly from the joinder sub-segment 42 to the loop 50, while the spring arm 48 extends outwardly from the loop 50 to an end 52. An optional stop member 54 is provided on the end 52 of the spring arm 48. The segment connectors 38 and 40 may each be referred to herein as a "primary" segment connector and/or a "secondary" segment connector.

The spring members 44*a* and 44*b* are received within the passageways 28 and 36 of the tubes 22 and 30 of the segments 12 and 14, respectively. The spring members 44*a* and 44*b* are biased to engage the segments 12 and 14, respectively. More specifically, the spring arm 46 of each spring member 44*a* and 44*b* is biased to engage a respective interior surface 56 and 58 of the respective tube 22 and 30. The engagement between the spring arms 46 and the respective surfaces 56 and 58 electrically connects the intermediate segment 16 to the segments 12 and 14. Accordingly, an electrical path is provided along the length of the electrical contact 10 from the outer end 18 of the segment 12, through the intermediate segment 16, to the outer end 20 of the segment 14. The friction and/or stiction created by the engagement of the spring arms 46 with the respective interior surface 56 and 58 mechanically connects the intermediate segment 16 to the segments 12 and 14. In other words, the friction and/or stiction created by the engagement of the spring arms 46 with the respective interior surface 56 and 58 holds the segment connectors 38 and 40 within the respective tubes 22 and 30.

As briefly described above, the segments 12 and 14 are each selectively positionable relative to the intermediate segment 16 such that the length L of the electrical contact 10 is adjustable. More specifically, the spring members 44*a* and 44*b* of the intermediate segment are slidably received within the respective passageways 28 and 36 of the respective tubes 22 and 30 of the segments 12 and 14, respectively. In other words, the segments 12 and 14 are configured to slide along the segment connectors 38 and 40, respectively, of the intermediate segment 16 in the directions of the arrows A and B, respectively. Accordingly, the length L of the electrical contact 10 can be adjusted along the different axes 24 and 32 by selectively positioning the segments 12 and 14 relative to the intermediate segment 16 along the respective axes 24 and 32. The stiction created by the engagement of the spring arms 46 with the respective interior surface 56 and 58 of the respective tubes 22 and 30 holds the segments 12 and 14, respectively, in the selected position relative to the intermediate segment 16.

The optional stop member 54 of each spring member 44*a* and 44*b* may provide a stop that limits movement of the corresponding segments 12 and 14 relative to the intermediate segment 16. More specifically, the stop members 54 engage the corresponding inner ends 26 and 34 of the segments 12 and 14, respectively, to limit movement of the respective segments 12 and 14.

FIG. 3 is a perspective view of another exemplary embodiment of an electrical contact 110. The electrical contact 110 includes a segment 112, a segment 114, and an intermediate segment 116. The intermediate segment 116 joins the segments 112 and 114 together to establish an electrical and mechanical connection between the segments 112 and 114. The segments 112 and 114 include respective outer ends 118 and 120 that define outer ends of the electrical contact 110. The electrical contact 110 extends a length $L_1$ defined from the outer end 118 of the segment 112 to the outer end 120 of the segment 114. As can be seen in FIG. 3, the segments 112 and 114 extend approximately parallel to each other such that the length $L_1$ of the electrical contact 110 extends along an approximately straight line. More specifically, the segments 112 and 114 extend along central longitudinal axes 124 and 132, respectively, that extend approximately parallel to each other. The segments 112 and 114 are each selectively positionable relative to the intermediate segment 116 along the respective arrows A and B such that the length $L_1$ of the electrical contact 110 is adjustable.

Figure 4:
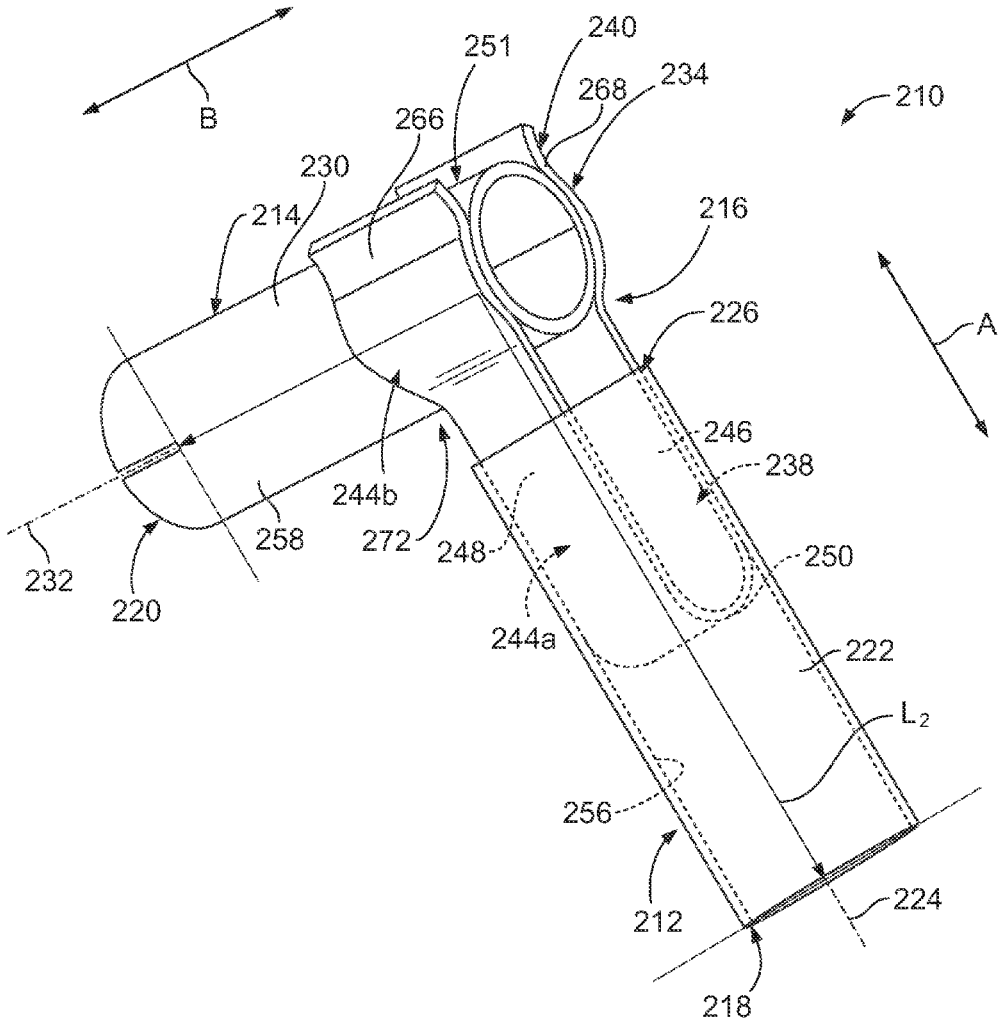
FIG. 4 is a perspective view of yet another exemplary embodiment of an electrical contact.
Figure 5:
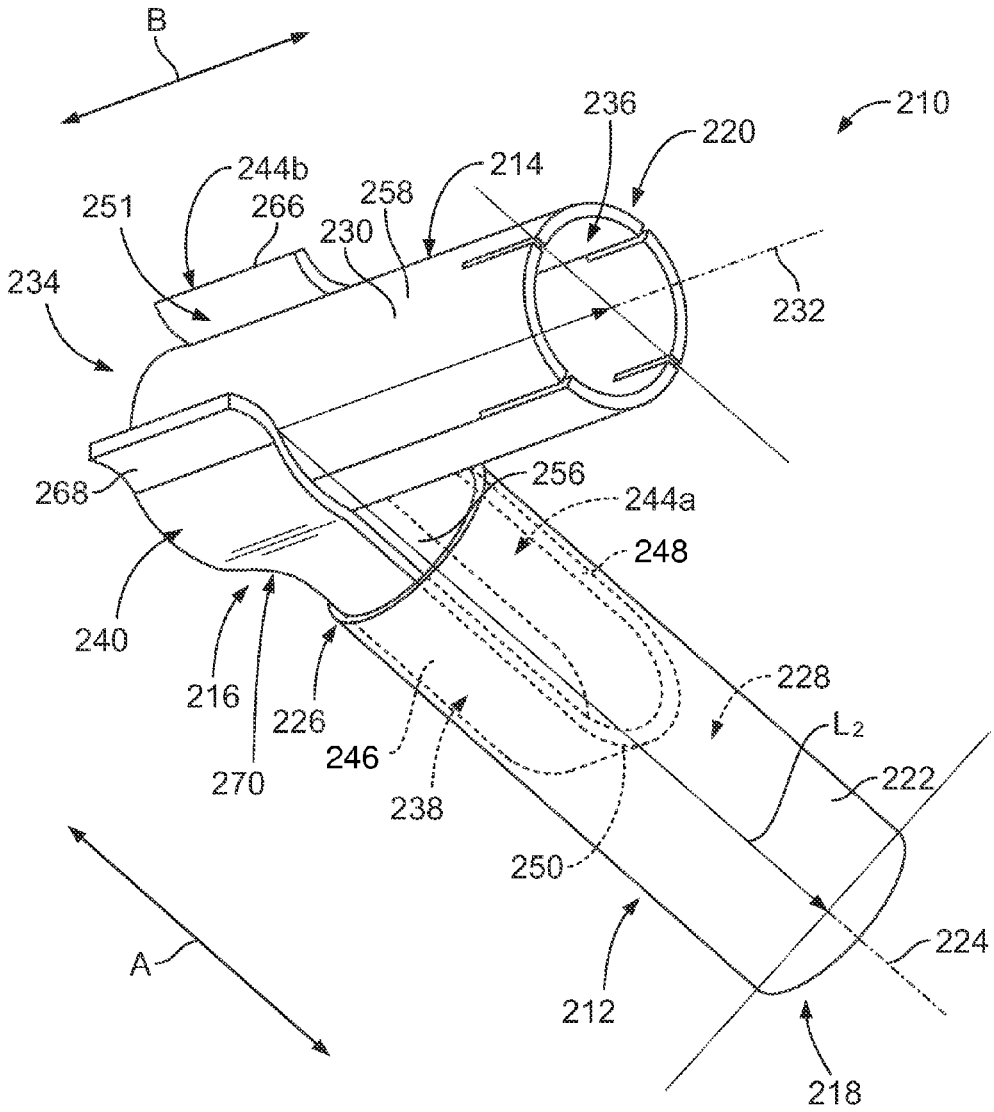
FIG. 5 is another perspective view of the electrical contact shown in FIG. 4 taken from a different angle than FIG. 4.

FIG. 4 is a perspective view of yet another exemplary embodiment of an electrical contact 210. FIG. 5 is a perspective view of the electrical contact 210 taken from a different angle than FIG. 4. Referring to FIGS. 4 and 5, the electrical contact 210 includes a segment 212, a segment 214, and an intermediate segment 216. The intermediate segment 216 joins the segments 212 and 214 together to establish an electrical and mechanical connection between the segments 212 and 214. The segments 212 and 214 include respective outer ends 218 and 220 that define outer ends of the electrical contact 210. The electrical contact 210 extends a length $L_2$ defined along a contact centerline from the outer end 218 of the segment 212 to the outer end 220 of the segment 214. The segments 212 and 214 are each selectively positionable relative to the intermediate segment 216 such that the length $L_2$ of the electrical contact 210 is adjustable.

In the exemplary embodiment of FIGS. 4 and 5, the length $L_2$ of the electrical contact 210 extends along a path that includes a bend of approximately 90°. In other embodiments, the length $L_2$ of the electrical contact 210 extends along an approximately straight path or extends along a path that includes a bend of another angle besides 90°. In the exemplary embodiment of FIGS. 4 and 5, the segments 212 and 214 include respective tubes 222 and 230 that extend lengths along respective central longitudinal axes 224 and 232 from respective inner ends 226 and 234 to the respective outer ends 218 and 220. The tubes 222 and 230 include passageways 228 and 236, respectively. The segments 212 and 214 may each be referred to herein as a "primary" segment and/or a "secondary" segment. The outer ends 218 and 220 may each be referred to herein as a "primary" outer end and/or a "secondary" outer end.

The intermediate segment 216 includes segment connectors 238 and 240 that engage the segments 212 and 214, respectively, such that the intermediate segment 216 is electrically and mechanically connected to the segments 212 and 214. The segment connectors 238 and 240 include respective spring members 244*a* and 244*b*. The spring member 244*a* includes a pair of spring arms 246 and 248 that are optionally connected together at an optional loop 250. The spring member 244*b* includes a pair of spring arms 266 and 268 and a passageway 251 defined between the arms 266 and 268. The spring arms 246 and 248 of the segment connector 238 extend outwardly from ends 270 and 272 of the spring arms 266 and 268, respectively, of the segment connector 240. Optionally, the ends 270 and 272 of the spring arms 266 and 268 are connected together at a loop (not shown). The segment connectors 238 and 240 may each be referred to herein as a "primary" segment connector and/or a "secondary" segment connector.

The spring member 244*a* is received within the passageway 228 of the tube 222 of the segment 212. The spring arms 246 and 248 of the spring member 244*a* are biased to engage an interior surface 256 of the tube 222. The engagement between the spring arms 246 and 248 and the interior surface 256 electrically connects the intermediate segment 216 to the segment 212. The friction and/or stiction created by the engagement of the spring arms 246 and 248 with the interior surface 256 mechanically connects the intermediate segment 216 to the segment 212. In other words, the friction and/or stiction created by the engagement of the spring arms 246 and 248 with the interior surface 256 holds the segment connector 238 within the tube 222.

The tube 230 of the segment 214 is received within the passageway 251 of the segment connector 240 of the intermediate segment 216. The spring arms 266 and 268 of the spring member 244*b* of the segment connector 240 are biased to engage an exterior surface 258 of the tube 230. The engagement between the spring arms 266 and 268 and the exterior surface 258 electrically connects the intermediate segment 216 to the segment 214. The friction and/or stiction created by the engagement of the spring arms 266 and 268 with the exterior surface 258 mechanically connects the intermediate segment 216 to the segment 214. In other words, the friction and/or stiction created by the engagement of the spring arms 266 and 268 with the exterior surface 258 holds the segment 214 within the passageway 251 of the segment connector 240. Accordingly, an electrical path is provided along the length $L_2$ of the electrical contact 210 from the outer end 218 of the segment 212, through the intermediate segment 216, to the outer end 220 of the segment 214.

The segments 212 and 214 are each selectively positionable relative to the intermediate segment 216 such that the length $L_2$ of the electrical contact 210 is adjustable. More specifically, the spring member 244*a* of the intermediate segment 216 is slidably received within the passageway 228 of the tube 222 of segment 212. The segment 212 is configured to slide along the segment connector 238 of the intermediate segment 216 in the directions of the arrow A. Accordingly, the length $L_2$ of the electrical contact 210 can be adjusted along the axis 224 by selectively positioning the segment 212 relative to the intermediate segment 16 along the axis 224. The stiction created by the engagement of the spring arms 246 and 248 with the interior surface 256 of the tube 222 holds the segment 212 in the selected position relative to the intermediate segment 216.

The tube 230 of the segment 214 is slidably received within the passageway 251 of the spring member 244*b* of the segment connector 238 of the intermediate segment 216. The segment 214 is configured to slide along the segment connector 240 of the intermediate segment 216 in the directions of the arrow B. Accordingly, the length $L_2$ of the electrical contact 210 can be adjusted along the axis 232 by selectively positioning the segment 214 relative to the intermediate segment 216 along the axis 232. The stiction created by the engagement of the spring arms 266 and 268 of the spring member 244*b* with the exterior surface 258 of the tube 230 holds the segment 214 in the selected position relative to the intermediate segment 216.

FIG. 6 is a cross-sectional view of a portion of an exemplary embodiment of an electrical connector 400. The electrical connector 400 will be described herein as including the electrical contact 10. However, the electrical connector 400 may include any of the electrical contacts described and/or illustrated herein. The electrical connector 400 includes a housing 402 having a contact opening 404. The housing 402 extends from a mating side 406 to a mounting side 408. In the exemplary embodiment of FIG. 6, the mating side 406 is oriented approximately perpendicular to the mounting side 408, such that the electrical connector 400 is a right angle connector. Alternatively, the mating side 406 is oriented parallel to the mounting side 408 and/or is oriented at an oblique angle relative to the mounting side 408.

An electrical contact 10 is held within the contact opening 404. The length L of the electrical contact 10 defines a path of the electrical contact 10 through the housing 402. In the exemplary embodiment of FIG. 6, the electrical contact 10 is held by the housing 402 such that the outer end 18 of the segment 12 is disposed along the mating side 406 of the housing 402, while the outer end 20 of the segment 14 is disposed along the mounting side 408. The segments 12 and 14 are each selectively positionable relative to the intermediate segment 16 such that the length L of the electrical contact 10 is adjustable.

The electrical connector 400 may be any type of electrical connector. For example, the electrical connector 400 may connect two circuit boards together, may connect two cables together, may connect a cable to a circuit board, may provide an intermediary connection between two other electrical connectors, and/or the like.

The embodiments described and/or illustrated herein may provide an electrical contact that has an adjustable length. The embodiments described and/or illustrated herein may provide an electrical contact that is interchangeable between housings having different sizes.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact comprising:

a primary segment comprising a primary outer end;

a secondary segment comprising a secondary outer end; and an intermediate segment joining the primary and secondary segments together, the intermediate segment comprising a primary segment connector engaged with the primary segment such that the intermediate segment is electrically and mechanically connected to the primary segment, the intermediate segment comprising a secondary segment connector engaged with the secondary segment such that the intermediate segment is electrically and mechanically connected to the secondary segment, at least one of the primary segment or the secondary segment comprising a tube having the respective primary segment connector or secondary segment connector of the intermediate segment received therein, wherein the electrical contact has a length defined from the primary outer end of the primary segment to the secondary outer end of the secondary segment, and wherein at least one of the primary segment is selectively positionable relative to the primary segment connector of the intermediate segment or the secondary segment is selectively positionable relative to the secondary segment connector of the intermediate segment such that the length of the electrical contact is adjustable.

2. The electrical contact of claim 1, wherein at least one of the primary segment is configured to slide along the primary segment connector of the intermediate segment or the secondary segment is configured to slide along the secondary segment connector of the intermediate segment.

3. The electrical contact of claim 1, wherein at least one of the primary segment connector or the secondary segment connector of the intermediate segment comprises a spring that is biased to engage the respective primary or secondary segment.

4. The electrical contact of claim 1, wherein the length of the electrical contact is adjustable along two different axes.

5. The electrical contact of claim 1, wherein the primary segment comprises a passageway, the primary segment connector of the intermediate segment being slidably received within the passageway and comprising a pair of arms connected together at a loop, at least one of the arms being engaged with the primary segment within the passageway to hold the primary segment connector within the passageway.

6. The electrical contact of claim 1, wherein the secondary segment comprises a passageway, the secondary segment connector of the intermediate segment being slidably received within the passageway and comprising a pair of spring arms, the spring arms being engaged with the secondary segment within the passageway to hold the secondary segment connector within the passageway.

7. The electrical contact of claim 1, wherein the primary segment extends at an approximate right angle relative to the secondary segment such that the length of the electrical contact comprises a bend of approximately 90°.

8. The electrical contact of claim 1, wherein the primary segment extends approximately parallel to the secondary segment such that the length of the electrical contact extends along an approximately straight path.

9. An electrical contact comprising:

a primary segment comprising a primary outer end;

a secondary segment comprising a secondary outer end; and an intermediate segment joining the primary and secondary segments together, the intermediate segment comprising a primary segment connector engaged with the primary segment such that the intermediate segment is electrically and mechanically connected to the primary segment, wherein the primary segment connector of the intermediate segment comprises a passageway defined between a pair of arms, the primary segment being slidably received within the passageway of the primary segment connector, the arms of the primary segment connector engaging the primary segment therebetween to hold the primary segment within the passageway of the primary segment connector, the intermediate segment comprising a secondary segment connector engaged with the secondary segment such that the intermediate segment is electrically and mechanically connected to the secondary segment, wherein the electrical contact has a length defined from the primary outer end of the primary segment to the secondary outer end of the secondary segment, and wherein at least one of the primary segment is selectively positionable relative to the primary segment connector of the intermediate segment or the secondary segment is selectively positionable relative to the secondary segment connector of the intermediate segment such that the length of the electrical contact is adjustable.

10. An electrical connector comprising:

a housing having a contact opening; and an electrical contact held within the contact opening of the housing, the electrical contact comprising:

a primary segment comprising a primary outer end;

a secondary segment comprising a secondary outer end; and an intermediate segment joining the primary and secondary segments together, the intermediate segment comprising a primary segment connector engaged with the primary segment such that the intermediate segment is electrically and mechanically connected to the primary segment, the intermediate segment comprising a secondary segment connector engaged with the secondary segment such that the intermediate segment is electrically and mechanically connected to the secondary segment, wherein the electrical contact has a length defined from the primary outer end of the primary segment to the secondary outer end of the secondary segment, wherein at least one of the primary segment is selectively positionable relative to the primary segment connector of the intermediate segment or the secondary segment is selectively positionable relative to the secondary segment connector of the intermediate segment such that the length of the electrical contact is adjustable, wherein the length of the electrical contact is adjustable along two different axes.

11. The electrical connector of claim 10, wherein at least one of the primary segment is configured to slide along the primary segment connector of the intermediate segment or the secondary segment is configured to slide along the secondary segment connector of the intermediate segment.

12. The electrical connector of claim 10, wherein the primary segment comprises a passageway, the primary segment connector of the intermediate segment being slidably received within the passageway and comprising a pair of arms connected together at a loop, at least one of the arms being engaged with the primary segment within the passageway to hold the primary segment connector within the passageway.

13. The electrical connector of claim 10, wherein the primary segment connector of the intermediate segment comprises a passageway defined between a pair of arms, the primary segment being slidably received within the passageway of the primary segment connector, the arms of the primary segment connector engaging the primary segment therebetween to hold the primary segment within the passageway of the primary segment connector.

14. The electrical connector of claim 10, wherein the secondary segment comprises a passageway, the secondary segment connector of the intermediate segment being slidably received within the passageway and comprising a pair of spring arms, the spring arms being engaged with the secondary segment within the passageway to hold the secondary segment connector within the passageway.

15. The electrical connector of claim 10, wherein the primary segment extends at an approximate right angle relative to the secondary segment such that the length of the electrical contact comprises an bend of approximately 90°.

16. An electrical contact comprising:

a primary segment comprising a primary outer end;

a secondary segment comprising a secondary outer end; and an intermediate segment joining the primary and secondary segments together, the intermediate segment comprising a primary segment connector and a secondary segment connector, the primary and secondary segment connectors comprising springs that are biased to engage the primary and secondary segments, respectively, to electrically and mechanically connect the intermediate segment to the primary and secondary segments, wherein the electrical contact has a length defined from the primary outer end of the primary segment to the secondary outer end of the secondary segment, wherein at least one of the primary segment is slidable along the primary segment connector of the intermediate segment between a plurality of different positions relative to the intermediate segment or the secondary segment is slidable along the secondary segment connector of the intermediate segment between a plurality of different positions relative to the intermediate segment such that the length of the electrical contact is adjustable, and wherein at least one of stiction between the primary segment and the primary segment connector holds the primary segment in the plurality of different positions relative to the intermediate segment or stiction between the secondary segment and the secondary segment connector holds the secondary segment in the plurality of different positions relative to the intermediate segment.

17. The electrical contact of claim 16, wherein the primary segment extends at an approximate right angle relative to the secondary segment such that the length of the electrical contact comprises a bend of approximately 90°.

18. The electrical contact of claim 16, wherein the length of the electrical contact is adjustable along two different axes.

* * * * *